US009608411B2

(12) United States Patent
Hisada

(10) Patent No.: US 9,608,411 B2
(45) Date of Patent: Mar. 28, 2017

(54) SPARK PLUG

(71) Applicant: NGK Spark Plug Co., LTD., Nagoya (JP)

(72) Inventor: Hidetaka Hisada, Obu (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/079,333

(22) Filed: Mar. 24, 2016

(65) Prior Publication Data

US 2016/0285240 A1 Sep. 29, 2016

(30) Foreign Application Priority Data

Mar. 26, 2015 (JP) ..... 2015-063632
Jan. 19, 2016 (JP) ..... 2016-007782

(51) Int. Cl.
*H01T 13/20* (2006.01)
*H01T 13/02* (2006.01)

(52) U.S. Cl.
CPC ..... *H01T 13/02* (2013.01); *H01T 13/20* (2013.01)

(58) Field of Classification Search
CPC ..... H01T 13/20; H01T 13/38
See application file for complete search history.

(56) References Cited

U.S. PATENT DOCUMENTS 6,091,185 A * 7/2000 Matsubara ..... H01T 13/20 313/118
6,215,233 B1 4/2001 Matsubara
6,628,050 B1 * 9/2003 Kameda ..... H01T 13/20 313/141
2005/0001526 A1 1/2005 Burrows
2010/0133978 A1 * 6/2010 Ishida ..... H01T 13/39 313/141

(Continued)

FOREIGN PATENT DOCUMENTS

JP 63-216282 A 9/1988
JP 09-45457 A 2/1997

(Continued)

OTHER PUBLICATIONS

Extended European Search Report mailed Aug. 12, 2016 for the corresponding European Patent Application No. 16158993.2.

(Continued)

*Primary Examiner* — Anne Hines
*Assistant Examiner* — Jose M Diaz
(74) *Attorney, Agent, or Firm* — Leason Ellis LLP

(57) ABSTRACT

In a spark plug, an annular gap is formed between a metallic shell and an outer surface of a leg portion of an insulator. A contact end position is provided at a front most position of a contact portion formed between a packing and the metallic shell. A radial distance between the outer surface of the leg portion and an inner surface of the metallic shell is a gap distance. A maximum end position is provided at the rear end of the annular gap maximum portion. The gap distance at a front end of the metallic shell is larger than the gap between the center electrode and the ground electrode. The metallic shell includes an increased inner diameter portion having an inner diameter at the front side relative to the contact end position. The maximum end position is located at the rear side relative to an intermediate position.

4 Claims, 7 Drawing Sheets

(56) References Cited

U.S. PATENT DOCUMENTS

| | | | | |
|---|---|---|---|---|
| 2015/0222095 | A1* | 8/2015 | Kuki | H01T 13/36<br>313/141 |
| 2016/0218487 | A1* | 7/2016 | Kobayashi | H01T 13/36 |

FOREIGN PATENT DOCUMENTS

| | | | |
|---|---|---|---|
| JP | 4187654 | B | 11/2008 |
| WO | WO-2011/118087 | A | 9/2011 |
| WO | WO-2014/030273 | A | 2/2014 |

OTHER PUBLICATIONS

Office Action mailed Feb. 7, 2017 for the corresponding Japanese Patent Application No. 2016-007782.

* cited by examiner

SPARK PLUG

This application claims the benefit of Japanese Patent Applications No. 2015-063632, filed Mar. 26, 2015 and No. 2016-007782 Jan. 19, 2016, all of which are incorporated herein by reference in its entity.

FIELD OF THE INVENTION

The present invention relates spark plugs.

BACKGROUND OF THE INVENTION

Conventionally, a spark plug has been used for an internal combustion engine. For example, such a spark plug includes an insulator having a through-hole, and a metallic shell disposed around the insulator in the radial direction. When the insulator is exposed to a combustion gas, carbon may be adhered to the surface of the insulator. Such carbon may cause a problem. For example, unintended discharge may occur inside the metallic shell through the carbon. As a technique for suppressing such a problem, a technique has been proposed in which the area of a space formed by the surface of a leg portion of the insulator and the inner wall surface of the metallic shell is reduced to prevent entry of the combustion gas, thereby improving anti-fouling characteristics of the leg portion of the insulator.

PRIOR ART DOCUMENT

Patent Document

[Patent Document 1] Japanese Patent Application Laid-Open (kokai) No. H9-45457

[Patent Document 2] Japanese Patent Application Laid-Open (kokai) No. S63-216282

[Patent Document 3] Japanese Patent No. 4187654

Problems to be Solved by the Invention

However, conventionally, any satisfactory technique has not been devised for suppressing deposition of carbon on the insulator.

The present invention discloses a technique for suppressing deposition of carbon on an insulator.

SUMMARY OF THE INVENTION

Means for Solving the Problems

The present invention discloses the following application examples.

APPLICATION EXAMPLE 1

A spark plug comprising:

an insulator including a reduced outer diameter portion having an outer diameter that decreases toward a front side in a direction of an axis, and a leg portion which is a portion on the front side relative to the reduced outer diameter portion, the insulator forming a through-hole extending in the direction of the axis;

a center electrode, at least a portion of which is inserted in the through-hole on the front side;

a metallic shell disposed around the insulator in a radial direction, the metallic shell including a reduced inner diameter portion having an inner diameter that decreases toward the front side, the metallic shell forming an annular gap between an inner peripheral surface of the reduced inner diameter portion of the shell and an outer peripheral surface of the leg portion of the insulator;

a ground electrode electrically connected to the metallic shell, and forming a gap in cooperation with the center electrode; and a packing disposed between the reduced outer diameter portion of the insulator and the reduced inner diameter portion of the metallic shell, wherein in a case where a contact end position is provided at a front most position of a contact portion formed between the packing and the metallic shell, a distance of the annual gap in the radial direction is regarded as a gap distance, and a maximum end position is provided at a rear end of a maximum gap portion, which is a portion having a maximum gap distance, the gap distance at a front end of the metallic shell is larger than a distance of the gap between the center electrode and the ground electrode, the metallic shell includes an increased inner diameter portion having an inner diameter that increases toward a rear side in the direction of the axis and is provided at the front side relative to the contact end position, and the maximum end position is located at the rear side relative to an intermediate position at which a distance in the direction of the axis between the contact end position and the front end of the metallic shell is divided into two halves.

According to this configuration, since the gap distance of the annular gap can be increased as compared to the case where the increased inner diameter portion of the metallic shell is omitted, ease of flow of the gas in the annular gap can be enhanced. Accordingly, it is possible to suppress carbon contained in the combustion gas from remaining in the annular gap, whereby deposition of carbon on the insulator can be suppressed.

APPLICATION EXAMPLE 2

The spark plug described in the application example 1, wherein on a cross section including the axis, one or more corner portions are formed by a surface of the front end of the metallic shell and a portion of the inner peripheral surface of the metallic shell, which portion is provided at the front side relative to the increased inner diameter portion, and each of the one or more corner portions has an acute angle.

According to this configuration, it is possible to suppress discharge from occurring in any of the one or more corner portions of the metallic shell, not in the ground electrode.

APPLICATION EXAMPLE 3

The spark plug described in the application example 1, wherein the increased inner diameter portion of the metallic shell includes a portion having an inner diameter that increases from the front end of the metallic shell toward the rear side.

According to this configuration, since the combustion gas that has flowed into the annular gap can easily flow out of the annular gap, it is possible to suppress carbon from remaining in the annular gap. Accordingly, deposition of carbon on the insulator can be suppressed.

APPLICATION EXAMPLE 4

The spark plug described in any of the application examples 1 to 3, wherein the metallic shell includes a portion having an inner diameter that decreases toward the rear side along a curved line which is convex outward in the radial direction, said portion provided at the rear side relative to the maximum end position.

According to this configuration, since the gap distance can be increased on the rear side relative to the maximum end position in the annular gap, ease of flow of the gas can be enhanced on the rear side relative to the maximum end position. Accordingly, it is possible to suppress carbon from remaining on the rear side relative to the maximum end position in the annular gap, whereby deposition of carbon on the insulator can be suppressed.

The present invention can be implemented in various forms. For example, the present invention may be implemented as a spark plug, an internal combustion engine equipped with the spark plug, and the like.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

A. Embodiment

Figure 1:
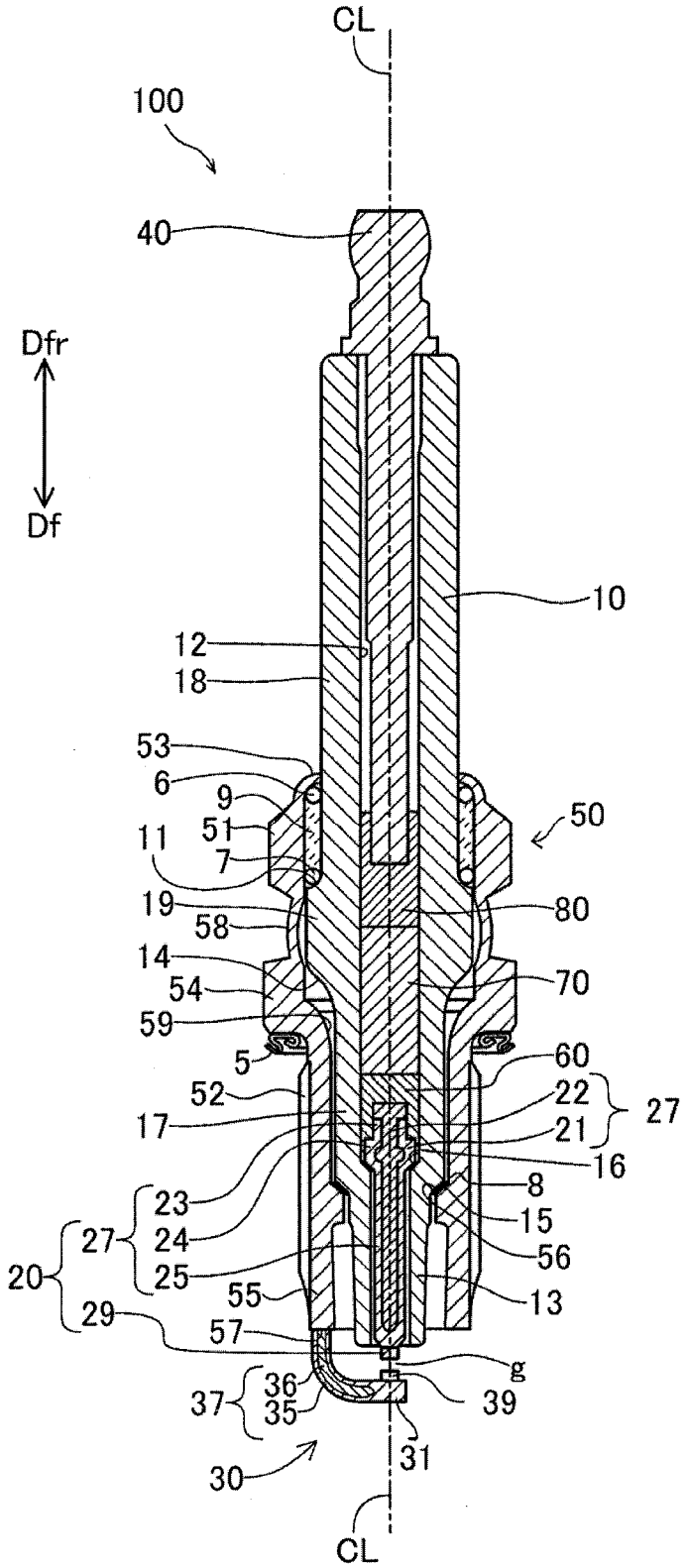
FIG. 1 is a cross-sectional view of an embodiment of a spark plug.

FIG. 1 is a cross-sectional view of an embodiment of a spark plug. In FIG. 1, a central axis CL (also referred to as "axis CL") of a spark plug 100 is shown. The cross section shown in FIG. 1 is a cross section including the central axis CL. Hereinafter, a direction parallel to the central axis CL is referred to as "direction of the axis CL", or simply as "axial direction" or "front-rear direction". The radial direction of a circle centered on the central axis CL is referred to simply as "radial direction", and the circumferential direction of the circle centered on the central axis CL is referred to as "circumferential direction". In the direction parallel to the central axis CL, the downward direction in FIG. 1 is referred to as a front end direction Df or a forward direction Df, and the upward direction in FIG. 1 is referred to as a rear end direction Dfr or a rearward direction Dfr. The front end direction Df is a direction from a metal terminal 40 described later toward electrodes 20 and 30 described later. In addition, the front end direction Df side in FIG. 1 is referred to as a front side of the spark plug 100, and the rear end direction Dfr side in FIG. 1 is referred to as a rear side of the spark plug 100.

The spark plug 100 includes an insulator 10, the center electrode 20, the ground electrode 30, the metal terminal 40, a metallic shell 50, a conductive first seal portion 60, a resistor 70, a conductive second seal portion 80, a front packing 8, a talc 9, a first rear packing 6, and a second rear packing 7.

The insulator 10 is a substantially cylindrical member having a through-hole 12 (hereinafter, also referred to as "axial bore 12") which extends along the central axis CL to penetrate the insulator 10. The insulator 10 is formed by baking alumina (another insulating material may be used). The insulator 10 includes a leg portion 13, a first reduced outer diameter portion 15, a front trunk portion 17, a third reduced outer diameter portion 14, a flange portion 19, a second reduced outer diameter portion 11, and a rear trunk portion 18 which are arranged in order from the front side toward the rearward direction Dfr. The flange portion 19 is a portion having a largest outer diameter in the insulator 10 (the flange portion 19 is also referred to as a large diameter portion 19). The outer diameter of the first reduced outer diameter portion 15 gradually decreases from the rear side toward the front side. Near the first reduced outer diameter portion 15 of the insulator 10 (in the front trunk portion 17 in the example shown in FIG. 1), a reduced inner diameter portion 16 is formed which has an inner diameter gradually decreasing from the rear side toward the front side. The outer diameter of the second reduced outer diameter portion 11 gradually decreases from the front side toward the rear side. The outer diameter of the third reduced outer diameter portion 14 gradually decreases from the rear side toward the front side.

As shown in FIG. 1, the center electrode 20 is inserted in the front side of the axial bore 12 of the insulator 10. The center electrode 20 includes a rod-shaped axial portion 27 extending along the central axis CL, and a first tip 29 joined to the front end of the axial portion 27. The axial portion 27 includes a leg portion 25, a flange portion 24, and a head portion 23 which are arranged in order from the front side to the backward Dfr. The first tip 29 is joined to the front end of the leg portion 25 (i.e., the front end of the axial portion 27) (e.g., by means of laser welding). In the present embodiment, at least a portion of the first tip 29 is exposed outside from the axial bore 12 on the front side of the insulator 10. A surface, on the forward direction Df side, of the flange portion 24 is supported by the first reduced inner diameter portion 16 of the insulator 10. In addition, the axial portion 27 includes an outer layer 21 and a core portion 22. The outer layer 21 is formed of a material (e.g., an alloy containing nickel) having more excellent oxidation resistance than the core portion 22. The core portion 22 is formed of a material (e.g., pure copper, a copper alloy, etc.) having a higher coefficient of thermal conductivity than the outer layer 21. The first tip 29 is formed by using a material (e.g., noble metals such as iridium (Ir) and platinum (Pt), tungsten (W), or an alloy containing at least one metal selected from these metals) having more excellent durability against discharge than the axial portion 27.

A portion of the metal terminal 40 is inserted in the rear side of the axial bore 12 of the insulator 10. The metal terminal 40 is formed by using a conductive material (e.g., a metal such as low-carbon steel).

In the axial bore 12 of the insulator 10, the resistor 70 which has a substantially columnar shape and serves to suppress electrical noise is disposed between the metal terminal 40 and the center electrode 20. The resistor 70 is formed by using, for example, a material containing a conductive material (e.g., carbon particles), ceramic particles (e.g., $ZrO_2$), and glass particles (e.g., $SiO_2$—$B_2O_3$—$Li_2O$—BaO-based glass particles). The conductive first seal portion 60 is disposed between the resistor 70 and the center electrode 20, and the conductive second seal portion 80 is disposed between the resistor 70 and the metal terminal 40. Each of the seal portions 60 and 80 is formed by using, for example, a material containing metal particles (e.g., Cu) and the same glass particles as those included in the material of the resistor 70. The center electrode 20 and the metal terminal 40 are electrically connected to each other via the resistor 70 and the seal portions 60 and 80.

The metallic shell 50 is a substantially cylindrical member having a through-hole 59 which extends along the central axis CL to penetrate the metallic shell 50. The metallic shell 50 is formed by using a low-carbon steel material (another conductive material (e.g., a metal material) may be used). The insulator 10 is inserted in the through-hole 59 of the metallic shell 50. The metallic shell 50 is fixed to the outer periphery of the insulator 10. On the forward direction Df side of the metallic shell 50, the front end of the insulator 10 (in the present embodiment, a portion, on the front side, of the leg portion 13) is exposed to the outside of the through-hole 59. That is, the front end of the insulator 10 is located on the forward direction Df side relative to the front end of the metallic shell 50. On the rear side of the metallic shell 50, the rear end of the insulator 10 (in the present embodiment, a portion, on the rear side, of the rear trunk portion 18) is exposed to the outside of the through-hole 59.

The metallic shell 50 includes a trunk portion 55, a seat portion 54, a deformable portion 58, a tool engagement portion 51, and a crimp portion 53 which are arranged in order from the front side toward the rear side. The seat portion 54 is a flange-like portion. The trunk portion 55 is a substantially cylindrical portion extending from the seat portion 54 toward the forward direction Df along the central axis CL. On the outer peripheral surface of the trunk portion 55, a thread 52 to be screwed into a mount hole of an internal combustion engine is formed. An annular gasket 5 which is formed by bending a metal plate is fitted between the seat portion 54 and the thread 52.

The metallic shell 50 includes a reduced inner diameter portion 56 disposed on the forward direction Df side relative to the deformable portion 58. The inner diameter of the reduced inner diameter portion 56 gradually decreases from the rear side toward the front side. The front packing 8 is interposed between the reduced inner diameter portion 56 of the metallic shell 50 and the first reduced outer diameter portion 15 of the insulator 10. The front packing 8 is an O-shaped ring made of iron (another material (e.g., a metal material such as copper) may be used).

The tool engagement portion 51 is a portion to be engaged with a tool (e.g., a spark plug wrench) for tightening the spark plug 100. The crimp portion 53 is disposed on the rear side relative to the second reduced outer diameter portion 11 of the insulator 10 and forms a rear end of the metallic shell 50 (i.e., an end on the rearward direction Dfr side). The crimp portion 53 is bent inward in the radial direction. On the forward direction Df side of the crimp portion 53, the first rear packing 6, the talc 9, and the second rear packing 7 are arranged between the inner peripheral surface of the metallic shell 50 and the outer peripheral surface of the insulator 10 in this order toward the forward direction Df. In the present embodiment, the rear packings 6 and 7 are C-shaped rings made of iron (another material may be used).

In manufacturing the spark plug 100, the crimp portion 53 is crimped so as to be bent inward. Then, the crimp portion 53 is pressed to the forward direction Df side. Accordingly, the deformable portion 58 deforms, and the insulator 10 is pressed toward the front side, in the metallic shell 50 via the packings 6 and 7 and the talc 9. The front packing 8 is pressed between the first reduced outer diameter portion 15 and the reduced inner diameter portion 56 to seal between the metallic shell 50 and the insulator 10. In this manner, the insulator 10 is fixed to the metallic shell 50.

In the present embodiment, the ground electrode 30 includes a rod-shaped axial portion 37, and a second tip 39 joined to a front end portion 31 of the axial portion 37. A rear end of the axial portion 37 is joined (by resistance welding, for example) to the surface of a front end 57 of the metallic shell 50 (i.e., the surface 57 on the forward direction Df side, also referred to as "front end surface 57"). The axial portion 37 extends from the front end surface 57 of the metallic shell 50 toward the forward direction Df, is bent toward the central axis CL, and reaches the front end portion 31. The front end portion 31 is disposed on the forward direction Df side of the center electrode 20. The second tip 39 is joined (by laser welding, for example) to a portion, on the center electrode 20 side, of the surface of the front end portion 31. The second tip 39 is formed by using a material (e.g., noble metals such as iridium (Ir) and platinum (Pt), tungsten (W), or an alloy containing at least one metal selected from these metals) having more excellent durability against discharge than the axial portion 37. The first tip 29 of the center electrode 20 and the second tip 39 of the ground electrode 30 form a gap g for spark discharge. The ground electrode 30 faces the front end portion of the center electrode 20 across the gap g.

The axial portion 37 of the ground electrode 30 includes an outer layer 35 that forms at least a portion of the surface of the axial portion 37, and a core portion 36 buried in the outer layer 35. The outer layer 35 is formed by using a material (e.g., an alloy containing nickel and chromium) having excellent oxidation resistance. The core portion 36 is formed by using a material (e.g., pure copper) having a higher coefficient of thermal conductivity than the outer layer 35.

Figure 2:
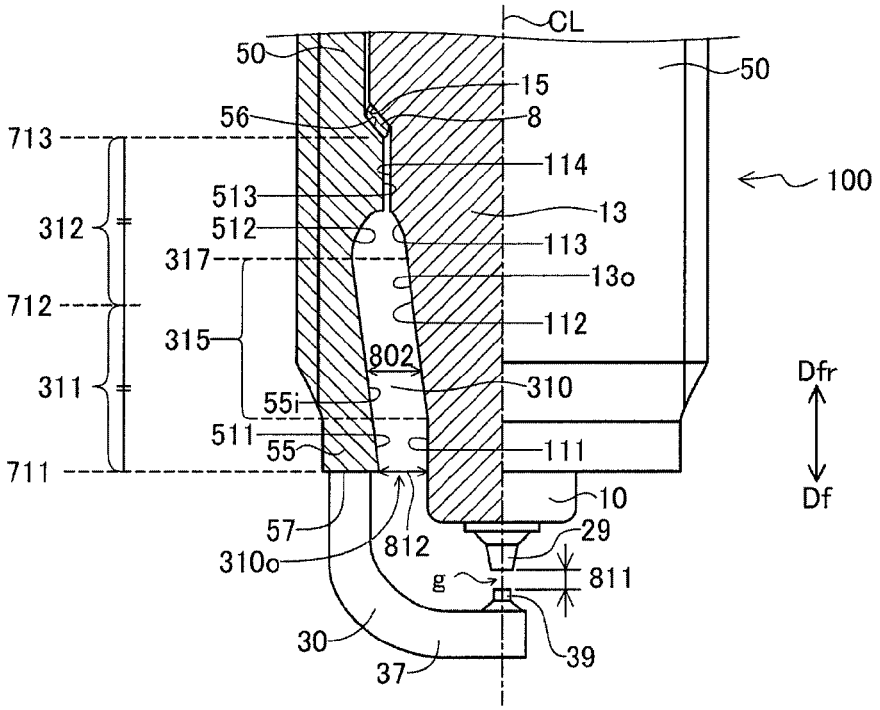
FIG. 2 is a schematic view showing a part of a spark plug 100 on the forward direction Df side.

FIG. 2 is a schematic view showing a portion, of the spark plug 100, on the forward direction Df side. The central axis CL is shown in FIG. 2. On the left side of the central axis CL, cross sections of the metallic shell 50 and the insulator 10, and an appearance of the ground electrode 30 are shown. In FIG. 2, illustration of the through-hole 12 of the insulator 10 and the internal structure of the through-hole 12 is omitted. On the right side of the central axis CL, an appearance of the spark plug 100 is shown.

On the forward direction Df side relative to the front packing 8, a gap 310 is formed between an inner peripheral surface 55*i* of the trunk portion 55 of the metallic shell 50 and an outer peripheral surface 13*o* of the leg portion 13 of the insulator 10. This gap 310 is an annular gap centering around the center axis CL. Hereinafter, a radial distance 802 of the annular gap 310, i.e., a radial distance 802 between the inner peripheral surface 55*i* of the metallic shell 50 and the outer peripheral surface 13*o* of the insulator 10 is referred to as "gap distance 802". The gap distance 802 is variable depending on positions in a direction parallel to the central axis CL. In FIG. 2, a front gap distance 812 is a gap distance at the front end 57 of the metallic shell 50 (i.e., an opening 310*o* of the gap 310). In the embodiment shown in FIG. 2, the front gap distance 812 is larger than a distance 811 of the gap g formed by the center electrode 20 and the ground electrode 30. The distance 811 of the gap g is the shortest distance of the gap g.

A portion, of the trunk portion 55 of the metallic shell 50, on the forward direction Df side relative to the reduced inner diameter portion 56 is divided into three portions 511, 512 and 513 arranged from the forward direction Df side toward the rear end direction Dfr. The first portion 511 is a portion including the front end 57. The inner diameter of the first portion 511 gradually increases from the front end 57 of the metallic shell 50 toward the rearward direction Dfr side (hereinafter, the first portion 511 is also referred to as "increased inner diameter portion 511"). In the embodiment shown in FIG. 2, on the cross section including the central axis CL, an inner peripheral surface of the first portion 511 is expressed by a straight line.

The inner diameter of the second portion 512 gradually decreases toward the rearward direction Dfr side. In the embodiment shown in FIG. 2, the inner diameter of the second portion 512 decreases along a curved-line that is convex outward in the radial direction. In other words, on the cross section including the central axis CL, an absolute value of a ratio of an amount of change in the inner diameter to an amount of change in position in the direction parallel to the central axis CL (i.e., a tilt of the inner peripheral surface 55*i* with respect to the central axis CL) gradually increases toward the rearward direction Dfr side. When the inner peripheral surface 55*i* is parallel to the central axis CL, the tilt of the inner peripheral surface 55*i* with respect to the central axis CL is zero degree. When the inner peripheral surface 55*i* is vertical to the central axis CL, the tilt of the inner peripheral surface 55*i* with respect to the central axis CL is 90 degrees. In the embodiment shown in FIG. 2, the tilt of the inner peripheral surface 55*i* with respect to the central axis CL in the second portion 512 increases from an angle less than 45 degrees to an angle exceeding 45 degrees, toward the rearward direction Dfr side.

The inner diameter of the third portion 513 is constant regardless of positions in the direction parallel to the central axis CL. The reduced inner diameter portion 56 is connected to a part of the third portion 513 on the rearward direction Dfr side. Hereinafter, the portion, the inner diameter of which is constant regardless of positions in the direction parallel to the central axis CL, like the third portion 513, is also referred to as "constant inner diameter portion".

The leg portion 13 of the insulator 10 is divided into four portions 111, 112, 113 and 114 arranged from the forward direction Df side toward the rear end direction Dfr. The first portion 111 is a portion including the front end of the insulator 10. The outer diameter of the first portion 111, excluding a corner at the front end, is constant regardless of positions in the direction parallel to the central axis CL.

The outer diameter of the second portion 112 gradually increases toward the rearward direction Dfr side. In the embodiment shown in FIG. 2, on the cross section including the central axis CL, the outer peripheral surface of the second portion 112 is expressed by a straight line. In addition, the second portion 112 of the insulator 10 faces the first portion 511 of the metallic shell 50. The outer peripheral surface of the second portion 112 is parallel to the inner peripheral surface of the first portion 511 of the metallic shell 50.

The outer diameter of the third portion 113 gradually increases toward the rearward direction Dfr side. In addition, the third portion 113 faces the second portion 512 of the metallic shell 50.

The outer diameter of the fourth portion 114 is constant regardless of positions in the direction parallel to the central axis CL. The fourth portion 114 of the insulator 10 faces the third portion 513 of the metallic shell 50. The first reduced outer diameter portion 15 is connected to a part of the fourth portion 114 on the rearward direction Dfr side.

A portion 315 shown in FIG. 2 is a portion, of the gap 310, having the maximum gap distance 802. Hereinafter, this portion 315 is also referred to as the maximum gap portion 315. In the embodiment shown in FIG. 2, the maximum gap portion 315 is a portion sandwiched between the first portion 511 of the metallic shell 50 and the second portion 112 of the insulator 10. A position 317 shown in FIG. 2 indicates a position of the rear end of the maximum gap portion 315 (hereinafter, also referred to as "maximum end position 317").

Three positions 711, 712 and 713 shown in FIG. 2 each indicate a position in the direction parallel to the central axis CL. The first position 711 indicates the position of the front end 57 of the metallic shell 50. The third position 713 is a position, at the frontmost side in the forward direction Df, in a contact portion of the metallic shell 50 and the front packing 8 (hereinafter, also referred to as "contact end position 713"). The second position 712 is a position at which the distance between the first position 711 and the third position 713 in the direction parallel to the central axis CL is divided into two halves (hereinafter also referred to as "intermediate position 712"). In the embodiment shown in FIG. 2, the rear end 317 of the maximum gap portion 315 is located on the rearward direction Dfr side relative to the intermediate position 712. The maximum gap portion 315 extends from a position on the forward direction Df side relative to the intermediate position 712 of the gap 310 to a position on the rearward direction Dfr side relative to the intermediate position 712. Hereinafter, a portion, of the gap 310, on the forward direction Df side relative to the intermediate position 712 is referred to as "front gap 311", and a portion, of the gap 310, on the rearward direction Dfr side relative to the intermediate position 712 is referred to as "rear gap 312".

B. First Evaluation Test

Figure 3:
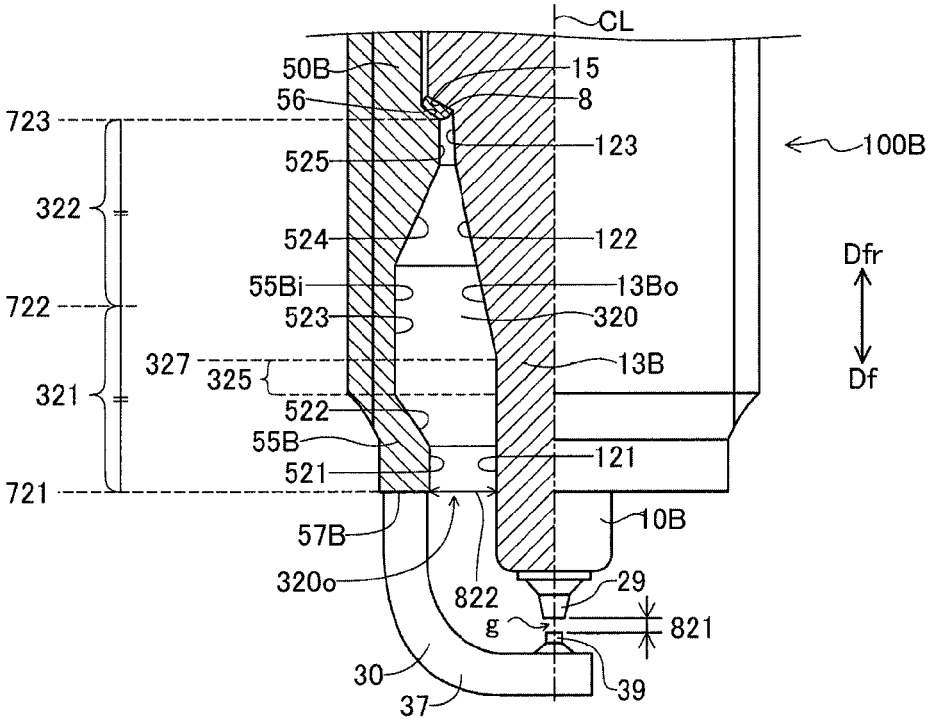
FIG. 3 is a schematic view of a spark plug 100B according to a first reference example.

A first evaluation test using samples of the spark plug 100 will be described. In the first evaluation test, anti-fouling characteristics were evaluated. In this evaluation test, in addition to the samples of the spark plug 100 (FIGS. 1 and 2), samples of a spark plug according to a first reference example were evaluated. FIG. 3 is a schematic view showing the spark plug 100B according to the first reference example. FIG. 3 shows, like FIG. 2, a cross section of a part of the spark plug 100B on the forward direction Df side, and an appearance of the spark plug 100B. A central axis CL shown in FIG. 3 is the central axis of the spark plug 100B. On the left side of the central axis CL, cross sections of a metallic shell 50B and an insulator 10B and an appearance of the ground electrode 30 are shown. In FIG. 3, illustration of the internal structure of the insulator 10B is omitted. On the right side of the central axis CL, an appearance of the spark plug 100B is shown. The first reference example is different from the embodiment shown in FIGS. 1 and 2 in that the cross-sectional shape of an inner peripheral surface 55Bi of a trunk portion 55B of the metallic shell 50B and the cross-sectional shape of an outer peripheral surface 13Bo of a leg portion 13B of the insulator 10B are different from the corresponding shapes shown in FIG. 2. The configuration of the other part of the spark plug 100B is the same as that of the corresponding part of the spark plug 100 shown in FIGS. 1 and 2 (the same elements as the corresponding elements are designated by the same reference numerals, and the description thereof is omitted).

On the forward direction Df side relative to the front packing 8, an annular gap 320 centering around the central axis CL is formed between the inner peripheral surface 55Bi of the trunk portion 55B of the metallic shell 50B and the outer peripheral surface 13Bo of the leg portion 13B of the insulator 10B. A front gap distance 822 at the front end of the metallic shell 50B (i.e., a gap distance at an opening 320*o* of the gap 320) is larger than a distance 821 of a gap formed by the center electrode 20 and the ground electrode 30. The front gap distance 822 of each sample of the first reference example is the same as the front gap distance 812 (FIG. 2) of each sample according to the embodiment.

A portion, of the trunk portion 55B of the metallic shell 50B, on the forward direction Df side relative to the reduced inner diameter portion 56 is divided into five portions 521, 522, 523, 524 and 525 arranged from the forward direction Df side toward the rear end direction Dfr. The first portion 521 is a portion including a front end surface 57B. The inner diameter of the first portion 521 is constant regardless of positions in the direction parallel to the central axis CL. Thus, the metallic shell 50B of the first reference example has the constant inner diameter portion 521 that forms a front end portion.

The inner diameter of the second portion 522 gradually increases toward the rearward direction Dfr side. On the cross section including the central axis CL, an inner peripheral surface of the second portion 522 is expressed by a straight line. The inner diameter of the third portion 523 is constant regardless of positions in the direction parallel to the central axis CL. The inner diameter of the fourth portion 524 gradually decreases toward the rearward direction Dfr side. On the cross section including the central axis CL, an inner peripheral surface of the fourth portion 524 is expressed by a straight line. The inner diameter of the fifth portion 525 is constant regardless of positions in the direction parallel to the central axis CL. The reduced inner diameter portion 56 is connected to a part of the fifth portion 525 on the rearward direction Dfr side.

The leg portion 13B of the insulator 10B is divided into three portions 121 122 and 123 arranged from the forward direction Df side toward the rear end direction Dfr. The first portion 121 is a portion including the front end of the insulator 10B. The outer diameter of the first portion 121, excluding a corner at the front end, is constant regardless of positions in the direction parallel to the central axis CL. The first portion 121 faces the entirety of the first and second portions 521 and 522 of the metallic shell 50B and a part of the third portion 523 on the forward direction Df side. The outer diameter of the second portion 122 gradually increases toward the rearward direction Dfr side. On the cross section including the central axis CL, the outer peripheral surface of the second portion 122 is expressed by a straight line. The second portion 122 faces a part, on the rearward direction Dfr side, of the third portion 523 of the metallic shell 50B and the entirety of the fourth portion 524. The outer diameter of the third portion 123 is constant regardless of positions in the direction parallel to the central axis CL. The third portion 123 faces the fifth portion 525 of the metallic shell 50B.

A portion 325 shown in FIG. 3 is a portion, of the gap 320, having the maximum gap distance. Hereinafter, this portion 325 is also referred to as a maximum gap portion 325. In the first reference example shown in FIG. 3, the maximum gap portion 325 is a portion sandwiched between the third portion 523 of the metallic shell 50B and the insulator 10B. A position 327 shown in FIG. 3 indicates a position of the rear end of the maximum gap portion 325.

In FIG. 3, three positions 721, 722 and 723 in the direction parallel to the central axis CL are shown. The first position 721 indicates the position of the front end of the metallic shell 50B. The third position 723 is a position, at the frontmost side in the forward direction Df, of a contact portion of the metallic shell 50B and the front packing 8. The second position 722 is a position at which the distance between the first position 721 and the third position 723 in the direction parallel to the central axis CL is divided into two halves (hereinafter also referred to as "intermediate position 722"). In the first reference example shown in FIG. 3, the rear end 327 of the maximum gap portion 325 is located on the forward direction Df side relative to the intermediate position 722. Thus, the entirety of the maximum gap portion 325 is located on the forward direction Df side relative to the intermediate position 722 of the gap 320. On the rearward direction Dfr side relative to the intermediate position 722, the gap distance is shorter than the gap distance of the maximum gap portion 325. In the first reference example, the gap distance decreases from the position on the forward direction Df side relative to the intermediate position 722 toward the rearward direction Dfr. Hereinafter, a portion, of the gap 320, on the forward direction Df side relative to the intermediate position 722 is referred to as "front gap 321", and a portion, of the gap 320, on the rearward direction Dfr side relative to the intermediate position 722 is referred to as "rear gap 322".

Figure 4A:
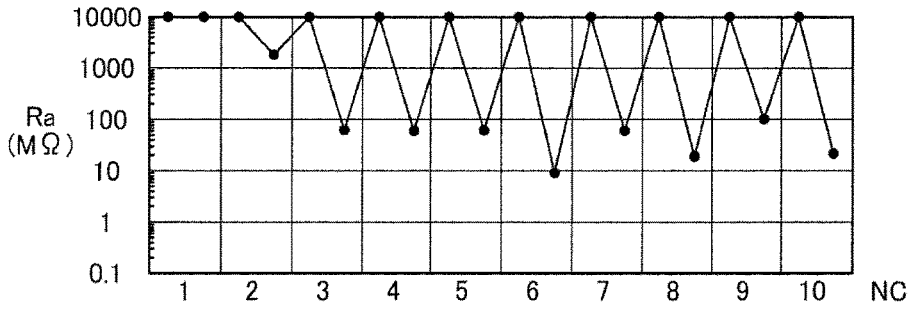
FIGS. 4A and 4B are graphs each of which shows a test result of a sample according to the embodiment.
Figure 4B:
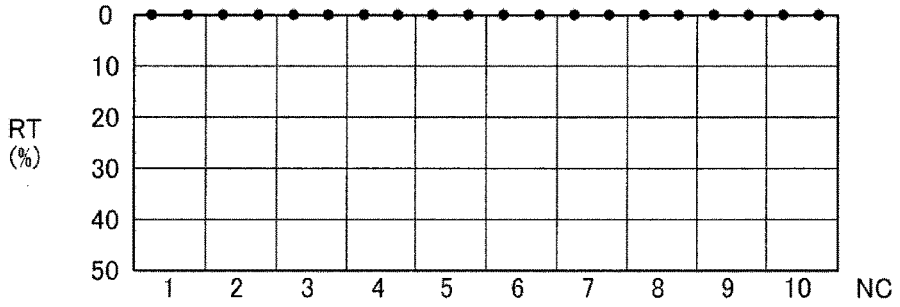
Figure 5A:
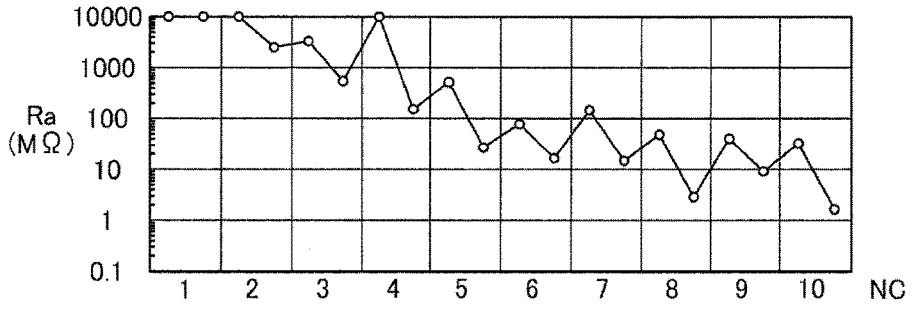
FIGS. 5A and 5B are graphs each of which shows a test result of a sample according to the first reference example.
Figure 5B:
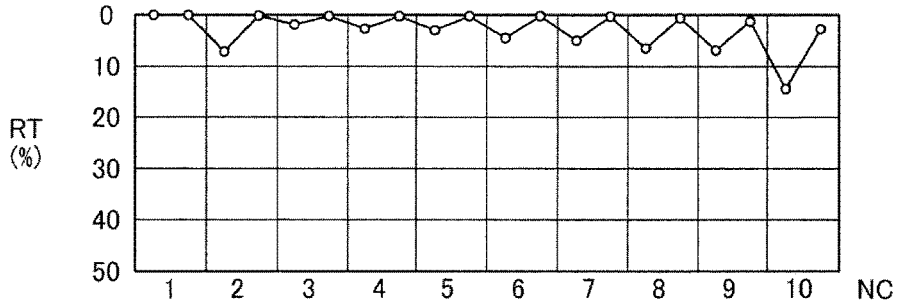

FIG. 4A and FIG. 4B are graphs showing the test results of the samples according to the embodiment, and FIG. 5A and FIG. 5B are graphs showing the test results of the samples of the first reference example. In FIG. 4A and FIG. 5A, the horizontal axis indicates the number of cycles NC in test operation, and the vertical axis indicates insulation resistance Ra (unit: MΩ). The scale on the vertical axis is a logarithmic scale. The insulation resistance Ra is an electric resistance between the metal terminal 40 and the metallic shell 50, 50B. In each graph, a scale point of 10000 MΩ indicates that the insulation resistance Ra is 10000 MΩ or more. In FIG. 4B and FIG. 5B, the horizontal axis indicates the number of cycles NC in test operation, and the vertical axis indicates leakage occurrence rate RT (unit: %). The upward direction of the vertical axis is a direction in which the leakage occurrence rate RT decreases.

In this evaluation test, leakage discharge is discharge which does not pass the gap g between the electrodes 20 and 30 but passes a passage from the center electrode 20 through the outer peripheral surface of the insulator 10, 10B to the inner peripheral surface of the metallic shell 50, 50B. The leakage occurrence rate RT is the rate of the number of occurrences of leakage discharge against application of a high voltage. In this evaluation test, four samples of the embodiment and four samples of the first reference example were tested. The insulation resistance Ra is the minimum value of the insulation resistances of the four samples. The leakage occurrence rate RT is the maximum value of the leakage occurrence rates of the four samples.

The test operation is as follows. A test car including a 4-cylinder engine having 1500 cc displacement is placed on a chassis dynamometer in a low-temperature test room (−10° C.). The four spark plug samples were mounted to the respective cylinders of the engine of the test car. Then, an operation consisting of a first operation and a second operation that follows the first operation was performed as one cycle of test operation. The first operation consists of, in order, "three times of racing", "a 40-second run at 35 km/h with the third gear position", "90-second idling", "a 40-second run at 35 km/h with the third gear position", "engine stop", and "cooling of the car until the temperature of cooling water reaches −10° C.". The second operation consists of, in order, "three times of racing", "three 15-second runs at 15 km/h with the first gear position, with 30-second engine halts therebetween", "engine stop", and "cooling of the car until the temperature of cooling water reaches −10° C.". The first operation is a high-load operation as compared to the second operation. The temperature of the spark plug is more likely to be increased in the first operation than in the second operation.

The test operation consisting of the first operation and the second operation was repeated ten times (ten cycles). At the end of the first operation and the end of the second operation in each cycle, each sample of the spark plug was dismounted from the engine to measure the insulation resistance Ra. In addition, the leakage occurrence rate RT in the first operation and the leakage occurrence rate RT in the second operation in each cycle were measured. The leakage occurrence rate RT in the first operation is as follows. All voltage waveforms at high-voltage application in the first operation were analyzed, and the ratio of the number of abnormal-waveform discharges (i.e., leakage discharges) to the total number of discharges was calculated as the leakage occurrence rate RT in the first operation. Likewise, the leakage occurrence rate RT in the second operation is the ratio of the number of abnormal-waveform discharges (i.e., leakage discharges) to the total number of discharges in the second operation.

In the graph of each figure, left-side data of each number of cycles NC indicates the measurement result of the insulation resistance Ra at the end of the first operation or the leakage occurrence rate RT in the first operation, and right-side data of each number of cycles NC indicates the measurement result of the insulation resistance Ra at the end of the second operation or the leakage occurrence rate RT in the second operation. As shown in the figure, at the end of the second operation, the insulation resistance Ra is reduced. However, at the end of the next first operation, the insulation resistance Ra is recovered. The reason is as follows. In the second operation, since the rotation speed of the engine is low, the temperature in the combustion chamber of the engine is low, and therefore carbon is likely to adhere to the outer peripheral surface of the insulator 10, 10B. In the first operation, since the rotation speed of the engine is high, the temperature in the combustion chamber is high, and therefore the carbon adhered to the outer peripheral surface of the insulator 10, 10B is burnt.

As shown in FIG. 4A, when the spark plug 100 according to the embodiment was used, although the insulation resistance Ra was reduced in the second operation, the insulation resistance Ra was recovered to 10000 MΩ or more in the first operation. Such recovery of the insulation resistance Ra due to the first operation constantly progressed over 10 cycles. It is estimated that, even when the number of cycles NC exceeds 10, the insulation resistance Ra will be recovered to 10000 MΩ or more by the first operation.

As shown in FIG. 5A, when the spark plug 100B according to the first reference example was used, recovery of the insulation resistance Ra to 10000 MΩ or more by the first operation could not be continued. In addition, the insulation resistance Ra was gradually reduced with increase in the number of cycles NC.

As shown in FIG. 4B, when the spark plug 100 according to the embodiment was used, the leakage occurrence rate RT was zero over 10 cycles. On the other hand, as shown in FIG. 5B, when the spark plug 100B of the first reference example was used, the leakage occurrence rate RT in the first operation tended to be higher than the leakage occurrence rate RT in the second operation. The reason is as follows. During the second operation, the amount of carbon adhered to the outer peripheral surface of the insulator 10B gradually increases. Accordingly, when the next first operation is started, leakage discharge is likely to occur because of the large amount of adhered carbon. During the first operation, the amount of carbon adhered to the outer peripheral surface of the insulator 10B gradually decreases because of burning or the like. Accordingly, when the next second operation is started, leakage discharge is not likely to occur because of the small amount of adhered carbon. In addition, since the first operation is high-load operation, leakage discharge is likely to occur in the first operation. On the other hand, since the second operation is low-load operation, leakage discharge is not likely to occur in the second operation. Thus, in the case where the first operation and the second operation are repeated, the leakage occurrence rate RT in the first operation can be increased, while the leakage occurrence rate RT in the second operation can be decreased.

The high leakage occurrence rate RT in the first operation indicates that the outer peripheral surface of the insulator is likely to be fouled, whereas the low leakage occurrence rate RT in the first operation indicates that the outer peripheral surface of the insulator is not likely to be fouled. When FIG. 4B is compared to FIG. 5B, the leakage occurrence rate RT of the spark plug 100 (FIG. 4B) according to the embodiment in the first operation is lower than the leakage occurrence rate RT of the spark plug 100B (FIG. 5B) of the first reference example in the first operation.

As described above, the anti-fouling characteristics of the spark plug 100 according to the embodiment are favorable as compared to the anti-fouling characteristics of the spark plug 100B of the first reference example. The reason can be estimated as follows. In the spark plug 100 according to the embodiment, the front gap distance 812 of the gap 310 (FIG. 2) is larger than the distance 811 of the gap g between the electrodes 20 and 30. In addition, the metallic shell 50 includes the first portion 511, the inner diameter of which increases toward the rearward direction Dfr side, on the forward direction Df side relative to the contact end position 713. Further, the rear end 317 of the maximum gap portion 315 is located on the rearward direction Dfr side relative to the intermediate position 712, that is, the maximum gap portion 315 extends toward the rearward direction Dfr side relative to the intermediate position 712. Therefore, ease of flow of the combustion gas is improved in the rear gap 312 and further in the gap 310. Thus, the combustion gas is suppressed from staying in the rear gap 312. Accordingly, deposition of carbon in the rear gap 312 and further in the gap 310 is suppressed. Since the high-temperature combustion gas easily flows in the gap 310, burning of the carbon adhered to the outer peripheral surface of the insulator 10 is promoted. Further, when the combustion gas flows into the rear gap 312, the combustion gas can easily flow out from the rear gap 312 and further from the gap 310. Accordingly, deposition of carbon on the outer peripheral surface 13*o* of the insulator 10 is suppressed. Furthermore, burning of carbon adhered to the outer peripheral surface 13*o* of the insulator 10 is promoted. As a result, leakage discharge can be suppressed. In addition, reduction in the insulation resistance can be suppressed.

Meanwhile, in the first reference example (FIG. 3), the rear end 327 of the maximum gap portion 325 is located on the forward direction Df side relative to the intermediate position 722. Accordingly, the gap distance is reduced in the rear gap 322, and the combustion gas is likely to stay in the rear gap 322. As a result, carbon is likely to be deposited on the outer peripheral surface of the insulator 10B in the rear gap 322. Since carbon is deposited on the outer peripheral surface of the insulator 10B in the rear gap 322 having the short gap distance, leakage discharge is likely to occur.

C. Second Evaluation Test

Figure 6:
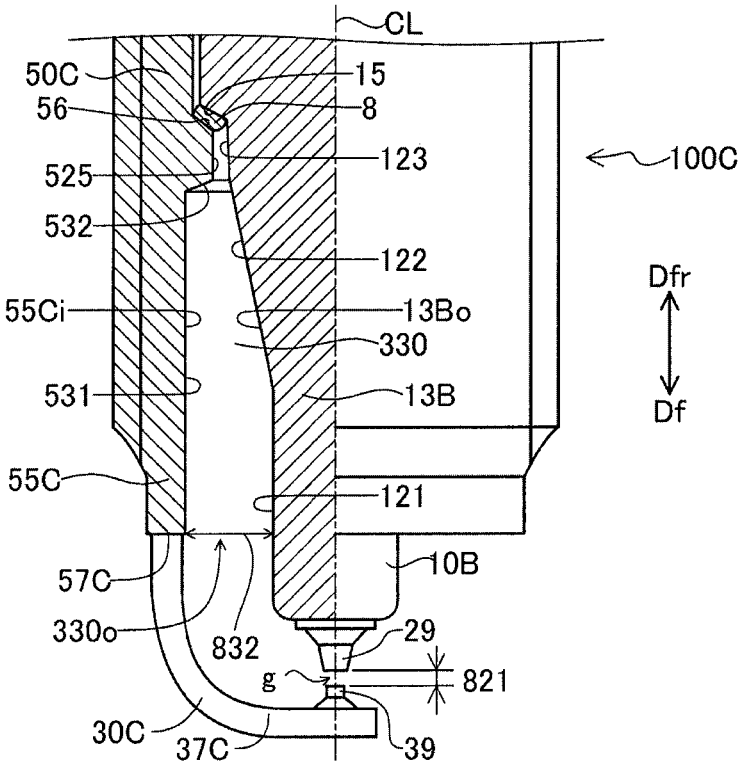
FIG. 6 is a schematic view of a spark plug 100C according to a second reference example.

In the second evaluation test, the relationship between a constant inner diameter portion (e.g., the first portion 521 shown in FIG. 3) which is formed at the front end portion of the metallic shell and reduces the inner diameter of the front end portion of the metallic shell, and ease of flow of the combustion gas in the annular gap, was evaluated. FIG. 6 is a schematic view of a spark plug 100C according to a second reference example. In the second evaluation test, the sample of the spark plug 100B of the first reference example shown in FIG. 3 and the sample of the spark plug 100C of the second reference example shown in FIG. 6, were evaluated.

The metallic shell 50C of the spark plug 100C shown in FIG. 6 is obtained by replacing the portions 521 to 524 on the forward direction Df side relative to the fifth portion 525 of the metallic shell 50B shown in FIG. 3 with a first portion 531 and a second portion 532 shown in FIG. 6. The first portion 531 extends from a front end surface 57C to a position near the fifth portion 525. The inner diameter of the first portion 531 is constant regardless of positions in the direction parallel to the central axis CL. The inner diameter of the first portion 531 is larger than the inner diameter of the first portion 521 of the metallic shell 50B shown in FIG. 3. In addition, a front gap distance 832 at a front end of the metallic shell 50C (i.e., a gap distance at an opening 330*o* of a gap 330) is larger than a distance 821 of a gap formed by the center electrode 20 and the ground electrode 30.

The inner diameter of the second portion 532 gradually decreases toward the rearward direction Dfr side. On the cross section including the central axis CL, an inner peripheral surface of the second portion 532 is expressed by a straight line. The fifth portion 525 is connected to a part of the second portion 532 on the rearward direction Dfr side. The radial width of the front end surface 57C of the metallic shell 50C is smaller than the radial width of the front end surface 57B of the metallic shell 50B shown in FIG. 3. The thickness of an axial portion 37C of a ground electrode 30C is adjusted to be small according to the width of the front end surface 57C of the metallic shell 50C. The configuration of the other part of the spark plug 100C shown in FIG. 6 is the same as that of the corresponding part of the spark plug 100B shown in FIG. 3 (the same elements as the corresponding elements are designated by the same reference numerals, and the description thereof is omitted). For example, the configuration of the insulator 10B is the same between the spark plug 100B shown in FIG. 3 and the spark plug 100C shown in FIG. 6.

Figure 7:
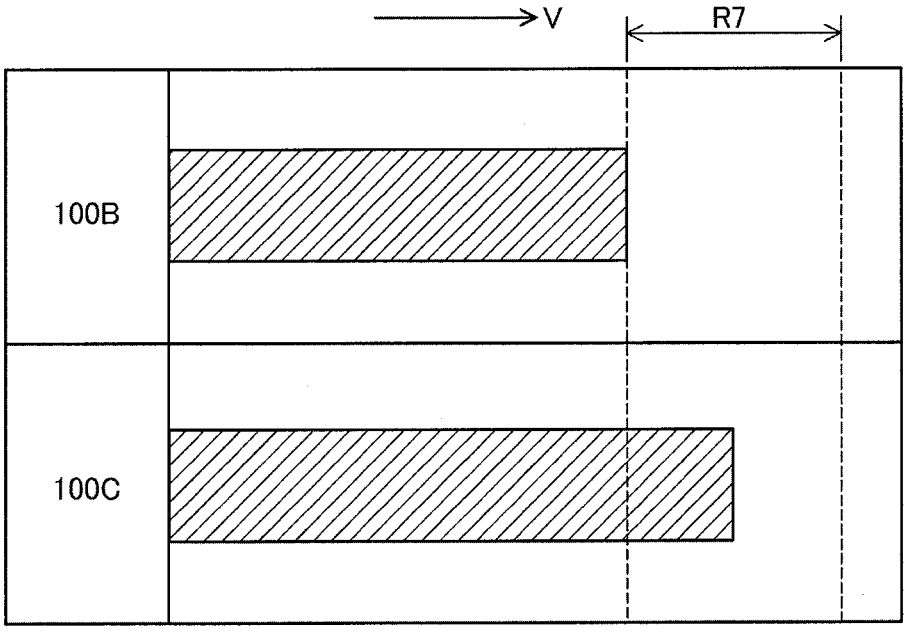
FIG. 7 is a graph showing a measurement result of a heat range.

FIG. 7 is a graph showing the measurement results of heat ranges. FIG. 7 shows the heat range of the sample of the spark plug 100B shown in FIG. 3 and the heat range of the sample of the spark plug 100C shown in FIG. 6. The horizontal axis indicates the heat range (the heat range increases rightward). The heat range indicates ease of heat dissipation. A large heat range indicates that the type of the spark plug is "cold type", that is, the spark plug is easy to cool, and temperature rise of the spark plug is suppressed. A small heat range indicates that the type of the spark plug is "hot type", that is, cooling of the spark plug is suppressed, and the temperature of the spark plug is easy to rise. In FIG. 7, a range R7 indicates a range corresponding to the seventh heat range.

As shown in FIG. 7, the heat range of the sample of the spark plug 100B according to the first reference example was smaller than the heat range of the sample of the spark plug 100C according to the second reference example. That is, in the sample of the spark plug 100B, temperature drop was suppressed as compared to the sample of the spark plug 100C.

The spark plug is heated by high-temperature combustion gas that flows into the gap between the metallic shell and the insulator (e.g., the gap 320, 330 shown in FIG. 3, FIG. 6). In the case where the high-temperature combustion gas in the gap is suppressed from flowing out of the gap, since the spark plug is continuously heated by the combustion gas, the spark plug is hard to cool, and the heat range is reduced. In the case where the high-temperature combustion gas in the gap is easy to flow out of the gap, the spark plug is easy to cool, and the heat range is increased. The first reference example (FIG. 3) and the second reference example (FIG. 6) have different shapes of the inner peripheral surfaces of the trunk portions 55B, 55C of the metallic shells 50B, 50C. The difference in shape of the inner peripheral surface causes a difference in ease of flow of the combustion gas from the gap 320, 330. The difference in heat range shown in FIG. 7 is estimated to be caused by the difference in ease of flow of the combustion gas from the gap 320, 330.

Specifically, in the case where the inner peripheral surface 55Bi of the metallic shell 50B of the spark plug 100B shown in FIG. 3 is traced from the rearward direction Dfr side toward the forward direction Df, the inner diameter is reduced by the second portion 522, and the reduced inner diameter is maintained by the first portion 521. The gap 320 is narrowed at a part including the opening 320*o* (a part formed by the first portion 521). Accordingly, it is estimated that the combustion gas that flows into the rearward direction Dfr side relative to the second portion 522 is suppressed from flowing out of the gap 320 through the narrow gap formed by the first portion 521. As described above, when the outflow of the combustion gas from the gap 320 is suppressed, the spark plug is hard to cool (the heat range is reduced). In the spark plug 100B of the first reference example, the estimation that the outflow of the combustion gas from the gap 320 is suppressed conforms with the small heat range of the spark plug 100B shown in FIG. 7. When the outflow of the combustion gas from the gap 320 is suppressed, carbon contained in the combustion gas is likely to remain in the gap 320. Accordingly, it is estimated that the outer peripheral surface of the insulator 10B is more likely to be fouled in the spark plug 100B shown in FIG. 3 than in the spark plug 100C shown in FIG. 6.

In the spark plug 100C shown in FIG. 6, a portion (e.g., the first portion 521 in FIG. 3) which is near the opening 330*o* of the gap 330 and narrows the inner diameter of the metallic shell 50C is omitted. Accordingly, it is estimated that the combustion gas that flows into the gap 330 can easily flow out of the gap 330. As described above, when the combustion gas can easily flow out of the gap 330, the spark plug is easy to cool (the heat range is increased). In the spark plug 100C of the second reference example, the estimation that the combustion gas easily flows out of the gap 330 conforms with the large heat range of the spark plug 100C shown in FIG. 7. When the combustion gas easily flows out of the gap 330, carbon containing in the combustion gas can be suppressed from remaining in the gap 330. Accordingly, it is estimated that fouling on the outer peripheral surface of the insulator 10B is more suppressed in the spark plug 100C shown in FIG. 6 than in the spark plug 100B shown in FIG. 3.

It is also estimated that fouling on the outer peripheral surface of the insulator 10 is more suppressed in the spark plug 100 shown in FIG. 2 than in the spark plug 100B shown in FIG. 3. The reason is as follows. The metallic shell 50 shown in FIG. 2 has a first portion 511, the inner diameter of which decreases toward the forward direction Df, like the second portion 522 of the metallic shell 50B shown in FIG. 3. However, the metallic shell 50 shown in FIG. 2 does not have a portion (e.g., the first portion 521 shown in FIG. 3) which maintains a small inner diameter from the front end of the metallic shell toward the rearward direction Dfr, like the metallic shell 50C shown in FIG. 6. In the first portion 511 of the metallic shell 50 shown in FIG. 2, the inner diameter increases from the front end 57 of the metallic shell 50 toward the rearward direction Dfr. Accordingly, it is estimated that, in the spark plug 100 shown in FIG. 2, like the spark plug 100C shown in FIG. 6, the combustion gas flowed into the gap 310 more easily flows out of the gap 310 as compared to the spark plug 100B shown in FIG. 3. Accordingly, it is estimated that, in the spark plug 100 shown in FIG. 2, deposition of carbon on the outer peripheral surface 13*o* of the insulator 10 is suppressed.

D. Third Evaluation Test

In the third evaluation test, the insulation resistance was measured in the state where carbon is adhered to the outer peripheral surface of the leg portion of the insulator due to test operation. In the third evaluation test, a sample of the spark plug 100 according to the embodiment shown in FIG. 2 and a sample of a spark plug 100D according to a reference example which includes the metallic shell 50C and the ground electrode 30C shown in FIG. 6, were evaluated. Portions of the spark plug 100D according to the reference example other than the metallic shell 50C and the ground electrode 30C are the same as the corresponding portions of the spark plug 100 shown in FIGS. 1 and 2. In the evaluation test, engines in which the samples of the spark plugs 100 and 100D are assembled, respectively, were operated under predetermined conditions. Thereafter, the insulators 10 of the spark plugs 100 and 100D were dismounted from the metallic shells 50 and 50C. Then, a first probe was fixed to the metal terminal 40, and a second probe was brought into contact with the outer peripheral surface of the leg portion 13 of the insulator 10. An electric resistance between these probes, that is, an electric resistance in a passage that passes from the second probe through the outer peripheral surface of the leg portion 13 to reach the center electrode 20 and passes from the center electrode 20 through the inside of the through-hole 12 of the insulator 10 to reach the metal terminal 40, was measured as an insulation resistance. Regarding contact positions of the second probe to the outer peripheral surface of the leg portion 13, thirteen positions were used which were selected at intervals of 1 mm in a range where the distance from the front end of the leg portion 13 is from 0 mm to 12 mm.

Figure 8:
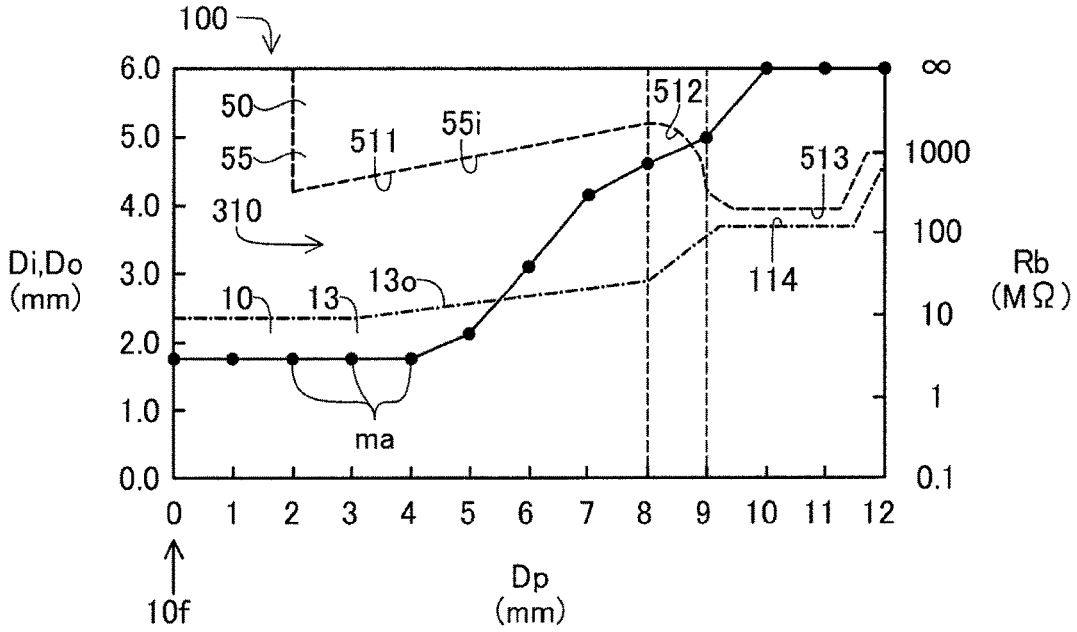
FIG. 8 is a graph showing a test result of a sample of the spark plug 100.
Figure 9:
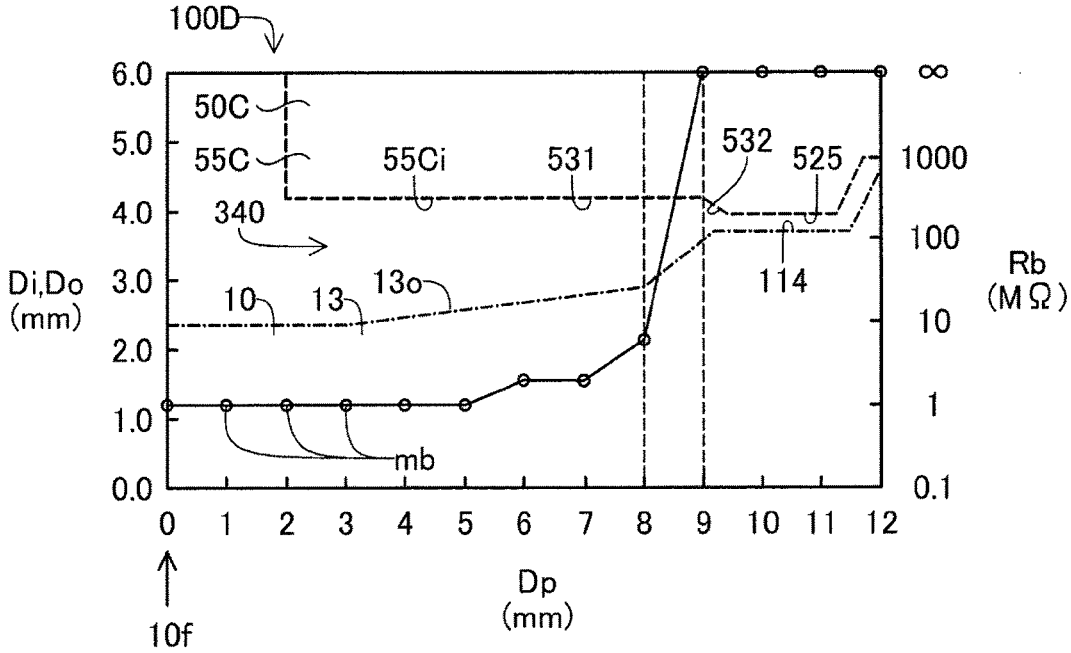
FIG. 9 is a graph showing a test result of a sample of a spark plug 100D.

FIG. 8 is a graph showing the test result of the sample of the spark plug 100, and FIG. 9 is a graph showing the test result of the sample of the spark plug 100D. The horizontal axis indicates positions Dp in the rearward direction Dfr based on the front end of the insulator 10. Each position Dp is indicated by the distance from the front end 10*f* of the insulator 10 in the rearward direction Dfr (unit: mm). The right-side vertical axis indicates the insulation resistance Rb (unit: MΩ). The scale on the right-side vertical axis is a logarithmic scale. A symbol of infinity indicates that the insulation resistance Rb is 10000 MΩ or more. Data points ma, mb each indicate the relationship between the position Dp of the second probe contact position and the measurement result of the insulation resistance Rb.

The left-side vertical axis indicates an outer diameter Do and an inner diameter Di (unit: mm). The outer diameter Do is the outer diameter of the outer peripheral surface 13*o* of the leg portion 13, and the inner diameter Di is the inner diameter of the inner peripheral surface 55*i*, 55Ci of the metallic shell 50, 50C. FIG. 8 and FIG. 9 each show the relationship between the position Dp and the outer diameter Do of the outer peripheral surface 13*o* of the leg portion 13, and the relationship between the position Dp and the inner diameter Di of the inner peripheral surface 55*i*, 55Ci of the metallic shell 50, 50C. In FIG. 9, a gap 340 is a gap between the inner peripheral surface 55Ci of the metallic shell 50C and the outer peripheral surface 13*o* of the insulator 10.

As shown in FIG. 8, the second portion 512 having a curved inner peripheral surface which is convex outward in the radial direction is disposed in the range of position Dp from 8 mm to 9 mm. In both FIG. 8 and FIG. 9, in the range of position Dp not less than 9 mm, the gap distance is less than 0.5 mm. Accordingly, it is estimated that the combustion gas flows mainly in the range of position Dp not larger than 9 mm. Further, a contact end position (e.g., the contact end position 713 shown in FIG. 2) was disposed in a range of position Dp from 11 mm to 12 mm although illustration thereof is omitted.

In the case where the amount of carbon adhered to the outer peripheral surface 13*o* of the leg portion 13 is great, the electric resistance at the outer peripheral surface 13*o* is reduced. Accordingly, the fact that the insulation resistance Rb is small indicates that the amount of carbon adhered to the outer peripheral surface 13*o* is great. As shown in FIG. 8, the closer the position Dp was to the front end 10*f*, that is, the closer the second probe was to the center electrode 20, the smaller the insulation resistance Rb was.

According to the measurement result shown in FIG. 8, in the range of position Dp from 4 mm to 9 mm (both inclusive), the closer the position Dp was to the front end 10*f*, the smaller the insulation resistance Rb was. In the range of position Dp not larger than 4 mm, the insulation resistance Rb was substantially constant regardless of the position Dp. In the range of position Dp not less than 6 mm, the insulation resistance Rb was larger than 10 M. In the range of position Dp not less than 7 mm, the insulation resistance Rb was larger than 100 M.

According to the measurement result shown in FIG. 9, in the range of position Dp from 8 mm to 9 mm (both inclusive), the insulation resistance Rb steeply decreased from 10000 MΩ or more to less than 10 MΩ, as the position Dp approached the front end 10*f*, 10Bf. The insulation resistance Rb was further decreased as the position Dp shifted from the position of 8 mm to the position of 5 mm.

In the range of position Dp not larger than 5 mm, the insulation resistance Rb was substantially constant regardless of the position Dp.

As described above, in the reference example shown in FIG. 9, the insulation resistance Rb steeply decreased from 10000 MΩ or more to less than 10 MΩ as the position Dp shifted from the position of 9 mm to the position of 8 mm. On the other hand, in the embodiment shown in FIG. 8, although the insulation resistance Rb decreased as the position Dp shifted from the position of 9 mm to the position of 8 mm, the insulation resistance Rb exceeding 500 MΩ was maintained at the position Dp of 8 mm. Thus, the behavior of the insulation resistance Rb between the two positions Dp, i.e., the position of 8 mm and the position of 9 mm, was significantly different between the embodiment shown in FIG. 8 and the reference example shown in FIG. 9. In addition, between the embodiment shown in FIG. 8 and the reference example shown in FIG. 9, although the shape of the insulator 10 is substantially the same, the shape of the inner peripheral surface 55*i*, 55Ci of the metallic shell 50, 50C is different between the position Dp of 8 mm and the position Dp of 9 mm. Accordingly, it is estimated that the difference in behavior of the insulation resistance Rb is mainly caused by the difference in shape of the inner peripheral surface 55*i*, 55Ci of the metallic shell 50, 50C.

In the reference example shown in FIG. 9, a portion of the metallic shell 50C between the two positions Dp of 8 mm and 9 mm is formed by the first portion 531. As described with reference to FIG. 6, the inner diameter of the first portion 531 is constant regardless of positions in the direction parallel to the central axis CL. Accordingly, in the space between the two positions Dp of 8 mm and 9 mm, the gap distance is reduced as compared to that in the embodiment shown in FIG. 8. Thus, flow of the combustion gas is suppressed. In the space between the two positions Dp of 8 mm and 9 mm and further in the range of position Dp closer to the front end 10*f* relative to the position of 8 mm, carbon is more likely to be deposited on the outer peripheral surface 13*o* of the leg portion 13 of the insulator 10, as compared to the embodiment shown in FIG. 8. The above description with respect to the reference example shown in FIG. 9 conforms with the measurement result shown in FIG. 9 in which the insulation resistance Rb steeply decreased due to the shift of the position Dp from the position of 9 mm to the position of 8 mm, and the insulation resistance Rb was small in the range of position Dp not larger than 8 mm.

The metallic shell 50 according to the embodiment shown in FIG. 8 has the second portion 512 between the two positions Dp of 8 mm and 9 mm. As described with reference to FIG. 2, the inner diameter of the second portion 512 gradually decreases toward the rearward direction Dfr side. In addition, the inner diameter of the second portion 512 decreases along a curved line which is convex outward in the radial direction. Accordingly, the gap distance can be increased between the two positions Dp of 8 mm and 9 mm, as compared to the reference example shown in FIG. 9. Thus, ease of flow of the combustion gas can be enhanced. Further, since the inner peripheral surface of the second portion 512 is expressed by a curved line on the cross section including the central axis CL, the direction in which the combustion gas flows can be smoothly changed along the inner peripheral surface, as compared with the case where the inner peripheral surface is expressed by a straight line or a broken line. Accordingly, ease of flow of the combustion gas can be enhanced. Further, the second portion 512 is disposed on the rearward direction Dfr side relative to the maximum end position 317 of the maximum gap portion 315 (FIG. 2). Accordingly, ease of flow of the combustion gas can be enhanced on the rearward direction Dfr side relative to the maximum end position 317. Thus, the combustion gas is suppressed from staying near the second portion 512 and further in the gap 310. Accordingly, deposition of carbon on the outer peripheral surface 13*o* of the insulator 10 can be suppressed near the second portion 512 and further in the gap 310, as compared to the reference example shown in FIG. 9. The above description relating to the embodiment shown in FIG. 8 conforms with the measurement result shown in FIG. 8 in which a large insulation resistance Rb (e.g., an insulation resistance Rb not smaller than 10 MΩ) can be achieved between the two positions Dp of 8 mm and 9 mm and further in the range of position Dp not less than 6 mm.

E. Modification (1) The configuration of the metallic shell is not limited to the above-described configurations, and other various configurations can be adopted. For example, the portion that forms the front end of the metallic shell may be a constant inner diameter portion that maintains a constant inner diameter in the rearward direction Dfr. In addition, the portion that forms the front end of the metallic shell may be a portion, the inner diameter of which decreases from the front end of the metallic shell toward the rearward direction Dfr.

Another portion may be formed between the maximum gap portion (e.g., the maximum gap portion 315 shown in FIG. 2) and the portion (e.g., the second portion 512 shown in FIG. 2), the inner diameter of which decreases along the curved line which is convex outward in the radial direction. For example, at least one of the constant inner diameter portion and the portion, the inner diameter of which decreases toward the rearward direction Dfr may be formed.

Regarding the shape of the inner peripheral surface of the portion, the inner diameter of which decreases toward the rearward direction Dfr on the rearward direction Dfr side relative to the maximum gap portion, any other shape may be adopted instead of the curved-line shape of the second portion 512 shown in FIG. 2. For example, a shape of a curved line which is convex inward in the radial direction may be adopted. The shape of the inner peripheral surface on the cross section including the central axis CL may be a shape expressed by at least one of a straight line, a broken line, and a curved line. The inner diameter may be changed stepwise with respect to change in position in the rearward direction Dfr.

Figure 10:
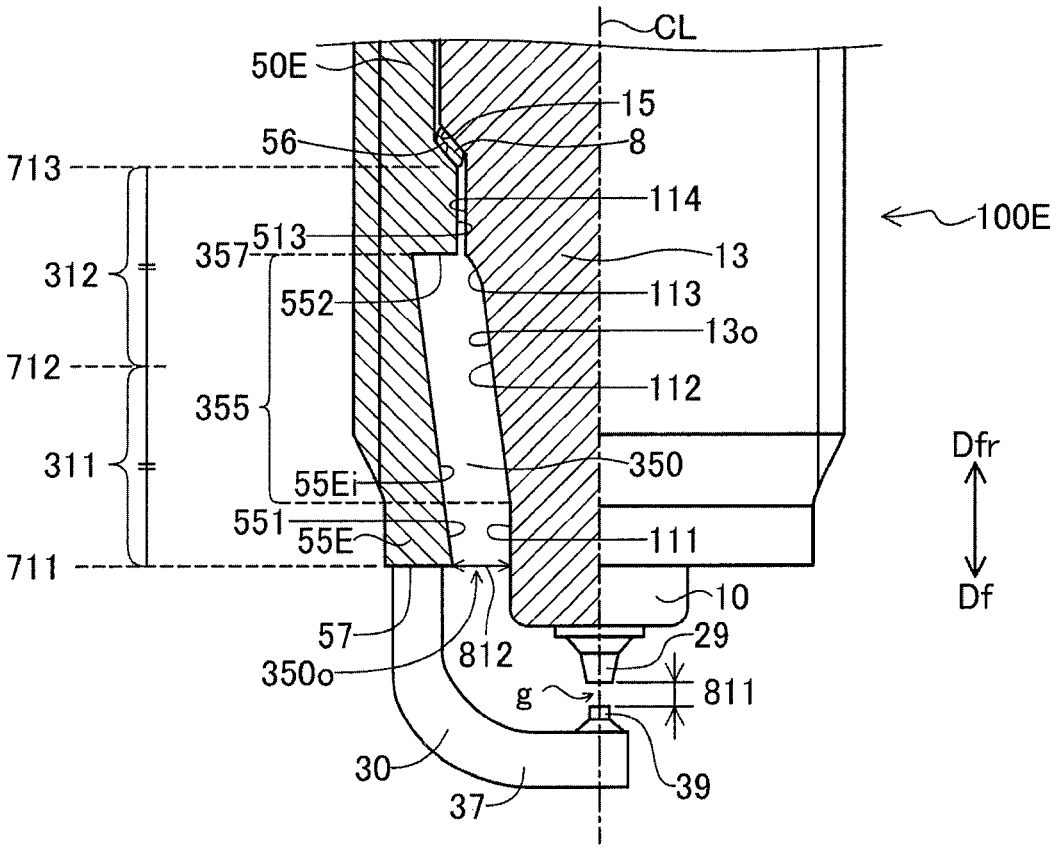
FIG. 10 is a schematic view showing a part, on the forward direction Df side, of a spark plug 100E according to another embodiment.

Alternatively, the inner diameter may decrease from the rear end of the maximum gap portion in a direction perpendicular to the central axis CL. FIG. 10 is a schematic view showing a portion, on the forward direction Df side, of a spark plug 100E according to another embodiment. A difference of the spark plug 100E from the spark plug 100 shown in FIG. 2 is as follows. A portion of a trunk portion 55E of a metallic shell 50E, on the forward direction Df side relative to the reduced inner diameter portion 56, is divided into three portions 551, 552 and 513 arranged from the forward direction Df side toward the rear end direction Dfr. The first portion 551 is a portion obtained by extending the first portion 511 shown in FIG. 2 to a position opposed to an end of the third portion 513 on the forward direction Df side. The second portion 552 is a surface perpendicular to the central axis CL, and connects an end of the first portion 551 on the rearward direction Dfr side to the end of the third portion 513 on the forward direction Df. The configuration of the other part of the spark plug 100E is the same as that of the corresponding part of the spark plug 100 shown in FIGS. 1 and 2 (the same elements as the corresponding elements are designated by the same reference numerals, and the description thereof is omitted). A gap 350 is a gap between an inner peripheral surface 55Ei of the metallic shell 50E and the outer peripheral surface 13*o* of the insulator 10. A maximum gap portion 355 is a portion, of the gap 350, having the maximum gap distance. A maximum end position 357 indicates the position of the rear end of the maximum gap portion 355. The maximum end position 357 is located on the rearward direction Dfr side relative to the intermediate position 712. In addition, the front gap distance 812 at the front end 57 of the metallic shell 50E (i.e., an opening 350*o* of the gap 350) is the same as the front gap distance 812 shown in FIG. 2, and is larger than the distance 811 of the gap g. It is estimated that, also in the spark plug 100E, deposition of carbon on the outer peripheral surface 13*o* of the insulator 10 can be suppressed.

Figure 11:
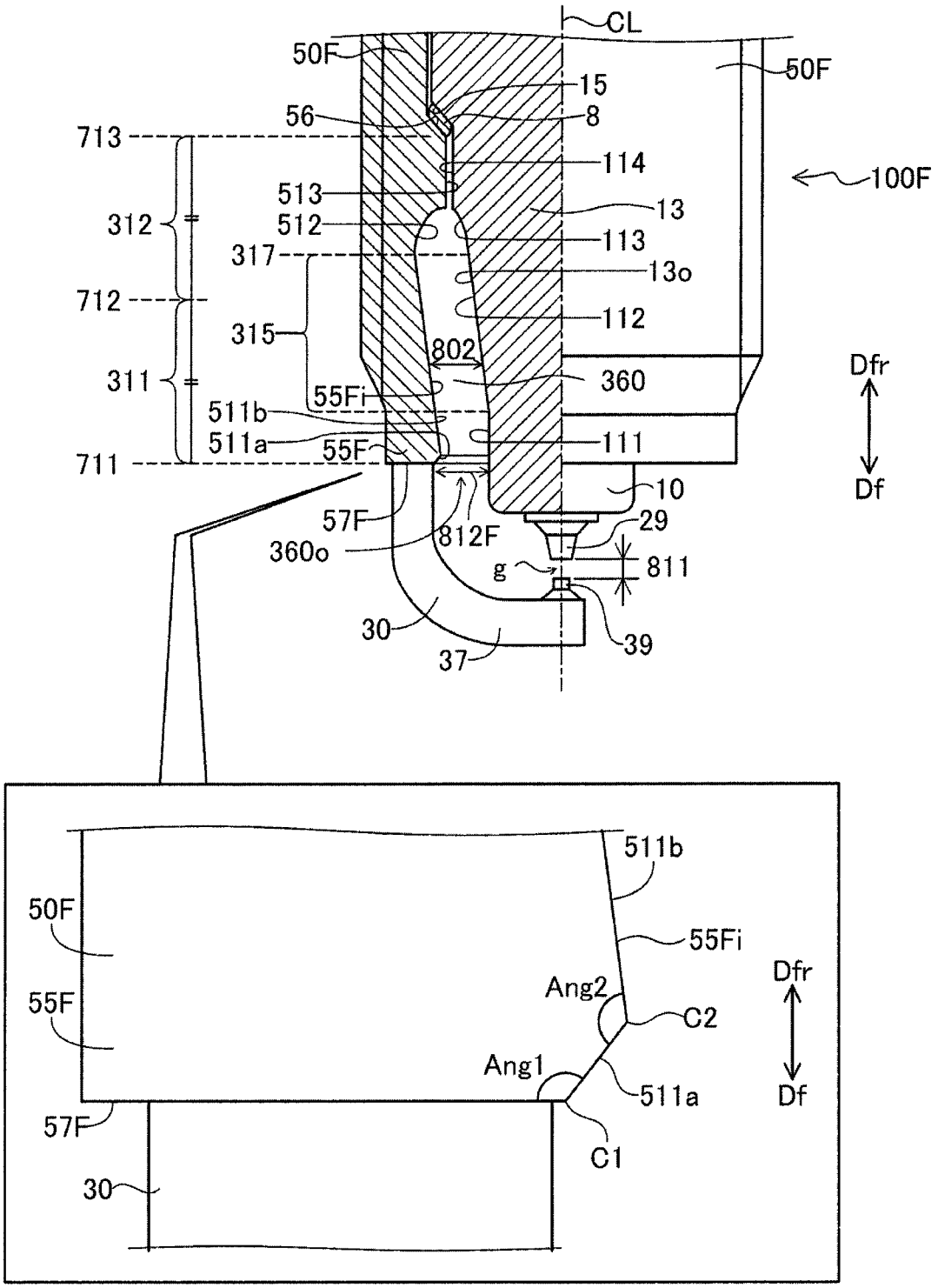
FIG. 11 is a schematic view showing a part, on the forward direction Df side, of a spark plug 100F according to still another embodiment.

On the cross section including the central axis CL, one or more corner portions may be formed by the surface of the front end of the metallic shell, and the portion on the forward direction Df side relative to the increased inner diameter portion which is a portion of the inner peripheral surface of the metallic shell, the inner diameter of which increases toward the rearward direction Dfr. FIG. 11 is a schematic view showing a portion, on the forward direction Df side, of a spark plug 100F according to another embodiment. In FIG. 11, a flat cross section including the central axis CL, like the cross section shown in FIG. 2, is shown. The spark plug 100F is different from the spark plug 100 shown in FIG. 2 only in that a corner portion formed by the front end surface 57 of the metallic shell 50 and the inner peripheral surface of the increased inner diameter portion 511 is chamfered to form a chamfered portion 511*a*. An enlarged cross-sectional view of the chamfered portion 511*a* and its vicinity is shown in a lower part of FIG. 11. The configuration of the other part of the spark plug 100F shown in FIG. 11 is the same as that of the corresponding part of the spark plug 100 shown in FIGS. 1 and 2 (the same elements as the corresponding elements are designated by the same reference numerals, and the description thereof is omitted).

In the embodiment shown in FIG. 11, the inner diameter of the chamfered portion 511*a* gradually decreases toward the rearward direction Dfr. On the cross section shown in FIG. 11, the inner peripheral surface of the chamfered portion 511*a* is expressed by a straight line. An increased inner diameter portion 511*b* is provided on the rearward direction Dfr side relative to the chamfered portion 511*a*. The shape of the increased inner diameter portion 511*b* is the same as the shape of the increased inner diameter portion 511 shown in FIG. 2 except that a portion corresponding to the chamfered portion 511*a* shown in FIG. 11 is removed. The configuration of the metallic shell 50F, except the chamfered portion 511*a*, is the same as that of the metallic shell 50 shown in FIG. 2. For example, the shape of an inner peripheral surface 55Fi of a trunk portion 55F of the metallic shell 50F is the same as the shape of the corresponding portion of the inner peripheral surface 55*i* of the trunk portion 55 of the metallic shell 50 shown in FIG. 2, except the inner peripheral surface of the chamfered portion 511*a*.

As shown in FIG. 11, the front end surface 57F of the metallic shell 50F and the inner peripheral surface of the chamfered portion 511*a* form a first corner portion C1, and the inner peripheral surface of the chamfered portion 511*a* and the inner peripheral surface of the increased inner diameter portion 511*b* form a second corner portion C2. On the cross section shown in FIG. 11, a first angle Ang1 indicates the angle of the first corner portion C1 (angle at the inner side of the metallic shell 50F), and a second angle Ang2 indicates the angle of the second corner portion C2. In the present embodiment, these angles Ang1 and Ang2 are larger than 90 degrees (i.e., obtuse angles). Generally, discharge is likely to occur at a sharp corner portion. If the inner peripheral surface of the metallic shell forms an angle not larger than 90 degrees, discharge may occur not between the ground electrode 30 and the center electrode 20 but between the corner portion of the metallic shell and the center electrode 20. In the embodiment shown in FIG. 11, each of the angles Ang1 and Ang2 of the two corner portions C1 and C2 is larger than 90 degrees, which corner portions are formed by the front end surface 57F of the metallic shell 50F, and the portion of the inner peripheral surface of the metallic shell 50F, on the front end direction Df side relative to the increased inner diameter portion 511*b* (i.e., the inner peripheral surface of the increased inner diameter portion 511*b* and the inner peripheral surface of the chamfered portion 511*a*). Accordingly, it is possible to suppress discharge from occurring between the corner portion C1, C2 of the metallic shell 50F and the center electrode 20, not in the gap g between the electrodes 20 and 30.

Further, the configuration of the spark plug 100F shown in FIG. 11 is the same as the configuration of the spark plug 100 shown in FIGS. 1 and 2 except that the chamfered portion 511*a* is formed. For example, the shape of a gap 360 between the inner peripheral surface 55Fi of the trunk portion 55F of the metallic shell 50F and the outer peripheral surface 13*o* of the leg portion 13 of the insulator 10 is the same as the shape of the gap 310 shown in FIG. 2 except a portion formed by the chamfered portion 511*a*. A front gap distance 812F at the front end 57F of the metallic shell 50F (i.e., an opening 360*o* of the gap 360) is larger than the distance 811 of the gap g. Thus, it is estimated that, like the spark plug 100 shown in FIGS. 1 and 2, the spark plug 100F shown in FIG. 11 can suppress deposition of carbon on the outer peripheral surface 13*o* of the insulator 10. The chamfered portion 511*a* shown in FIG. 11 may be applied to any of the metallic shells according to the above-described other embodiments (e.g., the metallic shell 50E shown in FIG. 10).

Generally, it is preferable that a metallic shell includes a portion, the inner diameter of which increases toward the rearward direction Dfr (also referred to as "increased inner diameter portion"), on the forward direction Df side relative to a contact end position (e.g., the contact end position 713 shown in FIG. 2). When the metallic shell includes the increased inner diameter portion, since the gap distance can be increased, ease of flow of the gas in a gap (e.g., the gap 310 shown in FIG. 2) can be enhanced. Regarding the shape of the inner peripheral surface of the increased inner diameter portion, any shape may be adopted. For example, the shape of the inner peripheral surface on the cross section including the central axis CL may be a shape expressed by at least one of a straight line, a broken line, and a curved line. The inner diameter may be changed stepwise with respect to change in position in the rearward direction Dfr.

The gap distance at the front end of the metallic shell is preferably larger than the distance of the gap between the center electrode and the ground electrode. In this configuration, a possibility can be reduced that discharge occurs in a passage from the center electrode through the outer peripheral surface of the insulator to the metallic shell. Further, since outflow of the combustion gas from the gap (e.g., the gap 310 shown in FIG. 2) between the inner peripheral surface of the metallic shell and the outer peripheral surface of the insulator to the outside of the gap is eased, deposition of carbon on the outer peripheral surface of the insulator can be suppressed.

The position of the end of the maximum gap portion on the rearward direction Dfr side (e.g., the maximum end position 317 of the maximum gap portion 315 shown in FIG. 2) is preferably located on the rearward direction Dfr side relative to the intermediate position at which the distance in the axial direction between the contact end position and the front end of the metallic shell is divided into two halves (e.g., the intermediate position 712 between the first position 711 and the contact end position 713 shown in FIG. 2). According to this configuration, since ease of flow of the fuel gas in the gap can be enhanced, it is possible to suppress carbon from remaining in the gap.

The metallic shell preferably includes at least one of "a portion, the inner diameter of which increases from the front end of the metallic shell toward the rear side, like the first portion 511 shown in FIG. 2", and "a portion, the inner diameter of which decreases along a curved line which is convex outward in the radial direction, toward the rear side, on the rear side relative to the maximum end position, like the second portion 512 shown in FIG. 2".

Regarding the shape of the portion of the inner peripheral surface of the metallic shell, on the front side from the increased inner diameter portion (also referred to as a front side inner peripheral surface), various shapes may be adopted. For example, the shape of the front side inner peripheral surface on the cross section including the central axis CL may be a shape expressed by at least one of a straight line, a broken line, and a curved line. Further, on the cross section including the central axis CL, the front end surface of the metallic shell and the front side inner peripheral surface may form one or more corner portions. Each corner portion is a portion in which two straight lines are connected on the cross section including the central axis CL. The total number of corner portions may be one, two, three or more. The angle of each of the one or more corner portions formed by the front end surface of the metallic shell and the front side inner peripheral surface on the cross section including the central axis CL (the angle not at the outer side but at the inner side of the metallic shell) is preferably an acute angle. According to this configuration, it is possible to suppress discharge from occurring in the corner portion of the metallic shell, not in the ground electrode.

(2) The configuration of the spark plug is not limited to the above-described configurations, and other various configurations may be adopted. For example, another member may be disposed between the ground electrode and the metallic shell. Generally, the ground electrode may be electrically connected to the metallic shell directly or via another member. At least one of the first tip 29 of the center electrode 20 and the second tip 39 of the ground electrode 30 may be omitted. Regarding the shape of the center electrode 20, various shapes different from the shape shown in FIG. 1 may be adopted. Regarding the shape of the ground electrode 30, various shapes different from the shape shown in FIG. 1 may be adopted.

Although the present invention has been described above based on the embodiments and the modified embodiments, the above-described embodiments of the invention are intended to facilitate understanding of the present invention, but not as limiting the present invention. The present invention can be changed and modified without departing from the gist thereof and the scope of the claims and equivalents thereof are encompassed in the present invention.

DESCRIPTION OF REFERENCE NUMERALS

5 . . . gasket
6 . . . first rear packing
7 . . . second rear packing
8 . . . front packing
9 . . . talc
10, 10B . . . insulator
10*f* . . . front end
11 . . . second reduced outer diameter portion
12 . . . through-hole (axial bore)
13, 13B . . . leg portion
13*o*, 13Bo . . . outer peripheral surface
14 . . . third reduced outer diameter portion
15 . . . first reduced outer diameter portion
16 . . . first reduced inner diameter portion
17 . . . front side trunk portion
18 . . . rear side trunk portion
19 . . . flange portion (large diameter portion)
20 . . . center electrode
21 . . . outer layer
22 . . . core portion
23 . . . head portion
24 . . . flange portion
25 . . . leg portion
27 . . . axial portion
29 . . . first tip
30, 30C . . . ground electrode
31 . . . front end portion
35 . . . outer layer
36 . . . core portion
37, 37C . . . axial portion
39 . . . second tip
40 . . . metal terminal
50, 50B, 50C, 50E, 50F . . . metallic shell
51 . . . tool engagement portion
52 . . . thread
53 . . . crimp portion
54 . . . seat portion
55, 55B, 55E, 55F . . . trunk portion
55*i*, 55Bi, 55Ci, 55Ei, 55Fi . . . inner peripheral surface
56 . . . reduced inner diameter portion
57, 57B, 57C, 57F . . . front end (front end surface)
58 . . . deformable portion
59 . . . through-hole
60 . . . first seal portion
70 . . . resistor
80 . . . second seal portion
100, 100B, 100C, 100D, 100E, 100F . . . spark plug
310, 320, 330, 340, 350, 360 . . . gap
310*o*, 320*o*, 330*o*, 350*o*, 360*o* . . . opening
311, 321 . . . front gap
312, 322 . . . rear gap
315, 325, 355 . . . maximum gap portion
317, 327, 357 . . . maximum end position (rear end)
511*a* . . . chamfered portion
511, 511*b* . . . increased inner diameter portion
711, 721 . . . first position
712, 722 . . . second position (intermediate position)
713, 723 . . . third position (contact end position)
802 . . . gap distance
811, 821 . . . distance
812, 822, 832 . . . front gap distance
g . . . gap
CL . . . central axis (axial line)
Df . . . front end direction (forward direction)
Dfr . . . rear end direction (rearward direction)

The invention claimed is:

1. A spark plug comprising:

an insulator including a reduced outer diameter portion having an outer diameter that decreases toward a front side in a direction of an axis, and a leg portion which is a portion on the front side relative to the reduced outer diameter portion, the insulator forming a through-hole extending in the direction of the axis;

a center electrode, at least a portion of which is inserted in the through-hole on the front side;

a metallic shell disposed around the insulator in a radial direction, the metallic shell including a reduced inner diameter portion having an inner diameter that decreases toward the front side, the metallic shell forming an annular gap between an inner peripheral surface of the reduced inner diameter portion of the metallic shell and an outer peripheral surface of the leg portion of the insulator;

a ground electrode electrically connected to the metallic shell, and forming a gap in cooperation with the center electrode; and a packing disposed between the reduced outer diameter portion of the insulator and the reduced inner diameter portion of the metallic shell, wherein in a case where a contact end position is provided at a front most position of a contact portion formed between the packing and the metallic shell, a distance of the annular gap in the radial direction is regarded as a gap distance, and a maximum end position is provided at a rear end of a maximum gap portion, which is a portion having a maximum gap distance, the gap distance at a front end of the metallic shell is larger than a distance of the gap between the center electrode and the ground electrode, the metallic shell includes an increased inner diameter portion having an inner diameter that increases toward a rear side in the direction of the axis and is provided at the front side relative to the contact end position, and the maximum end position is located at the rear side relative to an intermediate position at which a distance in the direction of the axis between the contact end position and the front end of the metallic shell is divided into two halves.

2. The spark plug according to claim 1, wherein on a cross section including the axis, one or more corner portions are formed by a surface of the front end of the metallic shell and a portion of an inner peripheral surface of the metallic shell, which portion is provided at the front side relative to the increased inner diameter portion, and each of the one or more corner portions has an acute angle.

3. The spark plug according to claim 1, wherein the increased inner diameter portion of the metallic shell includes a portion having an inner diameter that increases from the front end of the metallic shell toward the rear side.

4. The spark plug according to claim 1, wherein the metallic shell includes a portion having an inner diameter that decreases toward the rear side along a curved line which is convex outward in the radial direction, said portion provided at the rear side relative to the maximum end position.

* * * * *